US006123493A

United States Patent [19]

Politt

[11] Patent Number: 6,123,493

[45] Date of Patent: Sep. 26, 2000

[54] TOOL FOR A SEAMING MACHINE

[75] Inventor: Hans-Dietrich Politt, Baddeckenstedt, Germany

[73] Assignee: Schmalbach-Lubeca AG, Braunschweig, Germany

[21] Appl. No.: 09/241,129

[22] Filed: Feb. 1, 1999

Related U.S. Application Data

[63] Continuation of application No. 08/676,307, Jul. 18, 1996, Pat. No. 5,865,587, which is a continuation of application No. PCT/DE95/00059, Jan. 18, 1995.

[30] Foreign Application Priority Data

Jan. 19, 1994 [DE] Germany ..... 44 01 446

[51] Int. Cl.[7] ..... B21D 51/32

[52] U.S. Cl. ..... 413/6; 413/31

[58] Field of Search ..... 413/6, 4, 2, 36, 413/37, 38, 35, 33, 32, 31, 27, 26

[56] References Cited

U.S. PATENT DOCUMENTS

| | | | |
|---|---|---|---|
| 3,441,170 | 4/1969 | Khoury | 220/54 |
| 4,055,133 | 10/1977 | Wessely | 413/6 |
| 4,271,778 | 6/1981 | Le Bret | 413/6 |
| 4,354,784 | 10/1982 | Westphal | 413/12 |
| 4,392,295 | 7/1983 | Sasai et al. | 29/509 |
| 4,513,487 | 4/1985 | Binnie | 413/32 |
| 4,540,323 | 9/1985 | Inoue | 413/32 |
| 4,578,007 | 3/1986 | Diekhoff | 413/6 |
| 4,626,158 | 12/1986 | Le Bret | 413/6 |
| 5,049,019 | 9/1991 | Franek | 413/6 |
| 5,143,504 | 9/1992 | Braakman | 413/6 |
| 5,865,587 | 2/1999 | Politt | 413/31 |

FOREIGN PATENT DOCUMENTS

| | | |
|---|---|---|
| 0088968 | 7/1986 | European Pat. Off. . |
| 2303943 | 5/1974 | Germany . |
| 2121332 | 12/1983 | United Kingdom . |
| 2202777 | 10/1988 | United Kingdom . |
| 2225265 | 5/1990 | United Kingdom . |

OTHER PUBLICATIONS

Handbuch der Dosenfertigung, Von Waldemar Friebel VDI, Lübeck–1936, pp. 74–85.

*Primary Examiner*—James F. Coan
*Attorney, Agent, or Firm*—Duane, Morris & Heckscher

[57] ABSTRACT

Tooling for use with a folded cover seaming machine having a seaming chuck with a profile and a corresponding movable seaming roller formed with a mating profile operable to couple a can end to the walls of a can. The cross sectional thickness of the seaming roller in the transition area is reduced and the corresponding cross sectional thickness of the seaming chuck is increased. The increased thickness of the seaming chuck provides additional strength thereby reducing the occurrence of structural defects or fissures in the seaming chuck. The deceased thickness of the seaming roller provides a contour which minimizes the possibility of damage to cans and jamming of the seaming machine due to jamming in cases where no can end is supplied.

6 Claims, 3 Drawing Sheets

TOOL FOR A SEAMING MACHINE

CROSS REFERENCE TO RELATED APPLICATION

This is a continuation of application Ser. No. 08/676,307, filed Jul. 18, 1996, now U.S. Pat. No. 5,865,587.

BACKGROUND OF THE INVENTION

1. Field of the Invention

The invention relates to a tool for seaming machines.

2. Prior Art

Such a tool comprises of a central seaming chuck which engages the can end by contacting its chuck wall and pushing said can end into the can opening with its seaming chuck lip when lifting the supporting means carrying the upright standing can, and presses the flared flange of the can end against the flared flange of the can in a direction opposite to the resilience effective at said supporting means, maintaining said can end in a predetermined position with respect to the seaming rollers, thus allowing to radially adjust said rollers without impediment until their groove is able to engage said flared flanges lying one upon the other and to deform them in the desired manner. Can seaming machines for cans rotating during the seaming procedure are usually not provided with a stripping means above said seaming chuck lip. In these cases, said seaming rollers have stripping function. For this purpose, the diameter of said rollers above said profiled groove must be markedly larger than the diameter below said profiled groove and must overlap said seaming chuck lip in radial direction when the rollers are adjusted. For this purpose, a corresponding undercut is provided on the upper side of said seaming chuck in which undercut said roller section of larger diameter is received ("drives in") when adjusting the rollers.

The shape of said seaming chuck lip is substantially defined by said undercut and by a center recess on the lower surface of said seaming chuck, which recess is determined for receiving a tear-off means of tear-off can ends. Thus, the cross section of the transition area between lip and center section of said seaming chuck becomes relatively small with the risk of fissures or even breaks at said transition area due to strong alternating stresses. The risk increases with increasing chuck wall height of said can end and increasing height of said seaming chuck lip.

The center section of said seaming chuck could be enlarged to strengthen said transition area, but then, the stripping function of the seaming rollers is lost. If during a seaming procedure no can end was supplied to the can to be closed next, the seaming chuck is not able to press the can down against the resilience of said supporting means, when lifting said supporting means. Thus, the flared flange of the can is positioned considerably higher with respect to said seaming chuck lip and said seaming rollers. When (laterally) adjusting said seaming rollers, there is a risk that the flared flange of the can is rolled over the shoulder of the seaming chuck which shoulder being formed by the undercut; consequently, the can cannot be stripped and the machine has to be stopped.

SUMMARY OF THE INVENTION

The object of the invention is to avoid said disadvantages and to improve a tool for a seaming machine in such a way that, even in case of a large chuck wall height, there is no risk of fissures or breaks of the seaming chuck lip, no risk of forming or deforming said flared flange of the can over said seaming chuck if the can end is missing, and that the seaming rollers are able to reliably effect a stripping function.

According to the invention, the transition area between said seaming chuck lip and a center area of said seaming chuck is sufficiently strengthened to allow reliable resistance to strong alternating stresses even in case of great length of said lip. A desired stripping function of said seaming rollers is not affected thereby, because the necessary large diameter in the upper section of said rollers may be maintained by a corresponding selective reduction of the cross section of said rollers and, nevertheless, the roller is able to sufficiently engage the undercut of the seaming chuck when being adjusted.

If the can end is missing and the flared flange of the can is located correspondingly high, contouring provides a reliable engagement of said seaming rollers in their adjustment movement at the flared flange, without deforming said flange over said seaming chuck. Thus, the rollers are able to reliably strip the unseamed can in the further seaming procedure, so that no appreciable operating breakdown may occur.

The invention is described in detail by schematic drawings on the basis of several embodiments.

DETAILED DESCRIPTION OF THE PREFERRED EMBODIMENTS

Figure 1:
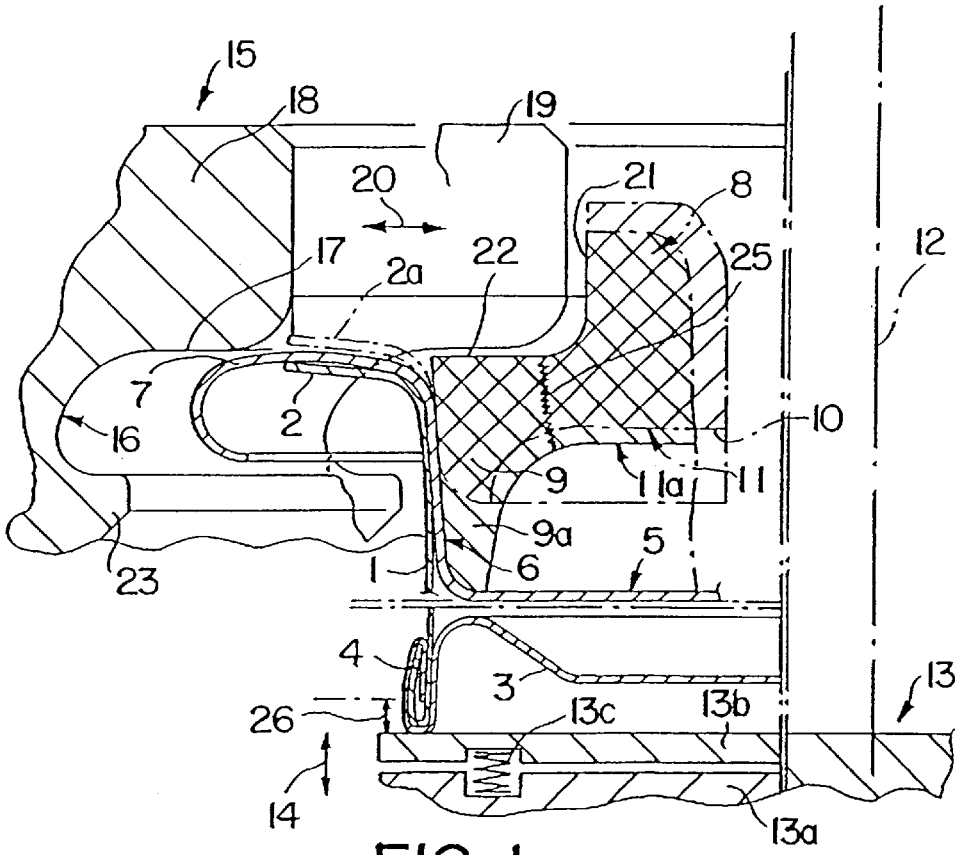
FIG. 1 is a cross-sectional view of a section of a tool for a seaming machine in accordance with the prior art.

Seaming machines for seamed can ends are generally known, so that a detailed illustration and description thereof is not necessary.

The present embodiment is based on a seaming machine not being provided with a stripping means above a seaming chuck lip to be described in the following. The appropriate tool for such a machine is provided with an elevating means 13, which may be lifted and lowered in direction of a tool axis and the supporting means 13*a* of which, receiving the cans standing upright, is resiliently supported by springs 13*c* or the like. The movement of said elevating means in direction of said tool axis 12 is indicated by a double arrow 14.

A seaming chuck 8, which may be stationary in axial direction, is positioned in the same axial direction as said elevating means. Said seaming chuck is provided with a recess 11 on its lower side, which recess being positioned and dimensioned such that a suitably shaped tear-off mechanism of a tear-off can end 5 may be received in it without contacting it.

Said seaming chuck has an undercut or turn-out 21,22 on its upper side. Said undercut and recess 11 delimit a seaming chuck lip 9 extending in radially outward direction and protruding downwards, the outer surface of which contacts the chuck wall 6 of said can, if said can 1 with said loosely positioned can end 5 is lifted by said elevating means 13 on which the bottom 3 of the can stands with its (lower) seamed edge for initiating the closing procedure.

FIG. 1 shows two typical shapes of seaming chucks having lips 9 and 9*a* of different lengths and different recesses 11 and 11*a* respectively. Said different lips are attributed to can ends with differently dimensioned chuck wall lengths or heights. If a can end 5 is positioned on the can, the flared flange 7 of said can end covers the flared flange 2 of said can. Seaming rollers 15 serve for forming the seam, one of which rollers is shown in FIG. 1 in a sectional view.

During the seaming process, the rotatable rollers are moved (adjusted) in radial direction with respect to axis 12 from a non-adjusted position as shown in hatched representation to a position illustrated by a simple contour line. Said adjustment movement is effected in a similar way as the lifting movement of said elevating means, e. g. by corresponding peripheral cams.

Said rollers 15 are provided each with a profiled groove 16 being open in radially inward direction and effecting the actual deformation. The upper delimitation flank 16*a* of said profiled groove 16 passes over a shoulder 17 extending in axial direction into a cylindrical surface of an upper roller section 18, the diameter of which is substantially larger than the diameter of a roller section 23 below said profiled groove 16. The diameter difference may for example be 6 mm. Said difference ensures that said upper roller section 18 engages said undercut 21,22 in the radially inner position 19 of said roller and overlaps said seaming chuck lip 9,9*a* in radial direction.

Said dimensioning is necessary to enable the seaming rollers 15 to engage the flared flange 2 of the can if the can end is missing and if the rollers are not adjusted, and to strip said can from said seaming chuck. Said adjustment movement of said rollers 15 is indicated by a double arrow 20.

FIG. 1 shows that the transitional cross section between said lip 9,9*a* and said center recess 10 of said seaming chuck is relatively narrow. Practice shows that fissures 25 may occur in said transitional area or that said lip completely breaks with the occurring strong alternating stresses.

FIG. 1 also shows that, if the can end is missing, springs 13*c* lift said can 1 with its flared flange 2 by a distance or range 26 to a position 2*a* with the consequence that, when adjusting said rollers 15, the flared flange of the can is pushed and deformed in inward direction over the shoulder 22 of said seaming chuck 8, so that said can may not be disengaged from said seaming chuck.

Figure 2:
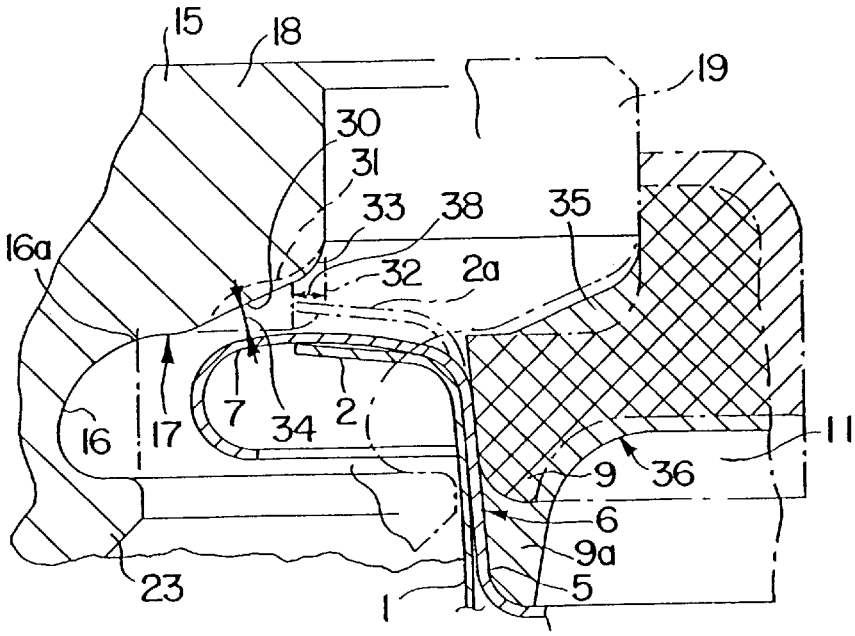
FIG. 2 is a similar view of a tool according to the invention.

In FIG. 2, said tool is modified in such a way that all the above mentioned dangers, risks and disadvantages are avoided. Similar components and sections, as far as they remain unchanged, are designated by the same reference numerals as in FIG. 1.

FIG. 2 illustrates that the transition area between said lip 9,9*a* and said center section of said seaming chuck is considerably strengthened by an increased diameter. Said diameter enlargement is located substantially in the direction of arrow 36 and is obtained by a diameter increase exclusively in a section 35 of said undercut by filling up an area situated in radially inward and axially downward direction of said undercut. The radial depth and the axial height of said undercut are thus generally maintained. The diameter portion added to said chuck is removed correspondingly at said rollers 15 without influencing either said profiled groove 16 or the diameter of said upper roller section 18. The engagement of said roller 15 into the undercut at position 19 as well as a radial overlapping 38 of the flared flange of said can in position 2*a* is possible without modification.

Reference numeral 32 indicates the original course of the contour of said roller, whereas reference numerals 30 and 31 indicate two out of many possible contour lines in the concerned area of said rollers 15.

It can be recognized that said seaming chuck lip 9,9*a* is considerably strengthened by the described measures. Practice shows that the risk of fissures or breaks is avoided even in case of high alternating stresses and very long lips 9,9*a*.

Even in cases, where a strengthening of said lip 9,9*a* seems not to be necessary, it was found to be of advantage to provide instead of said contour line 35 a contour line 30 or 31 or similar on said seaming rollers at the axially tending shoulder 17, such that said line extends from about the upper delimitation of said profiled groove and continues in radially inward and axially upward direction. The average angle 34 should be below 60° and preferably about 45° or less. The contoured line may define a tapered surface or an irregularly profiled surface.

By said measure it is avoided that, if said can end 5 is missing, said rollers 15 take said flared flange 2 of the can along from a position 2*a* in their radial adjustment movement and deform it in radial direction over the shoulder 22 of said seaming chuck 8.

As illustrated by FIG. 2, the steps taken to modify the cross section and to modify the contour of said rollers may be coordinated to achieve the desired strengthening of said seaming chuck lip 9,9*a* as well as the desired engagement inclination 30,31 for said flared flange 2*a*.

Figure 3A:
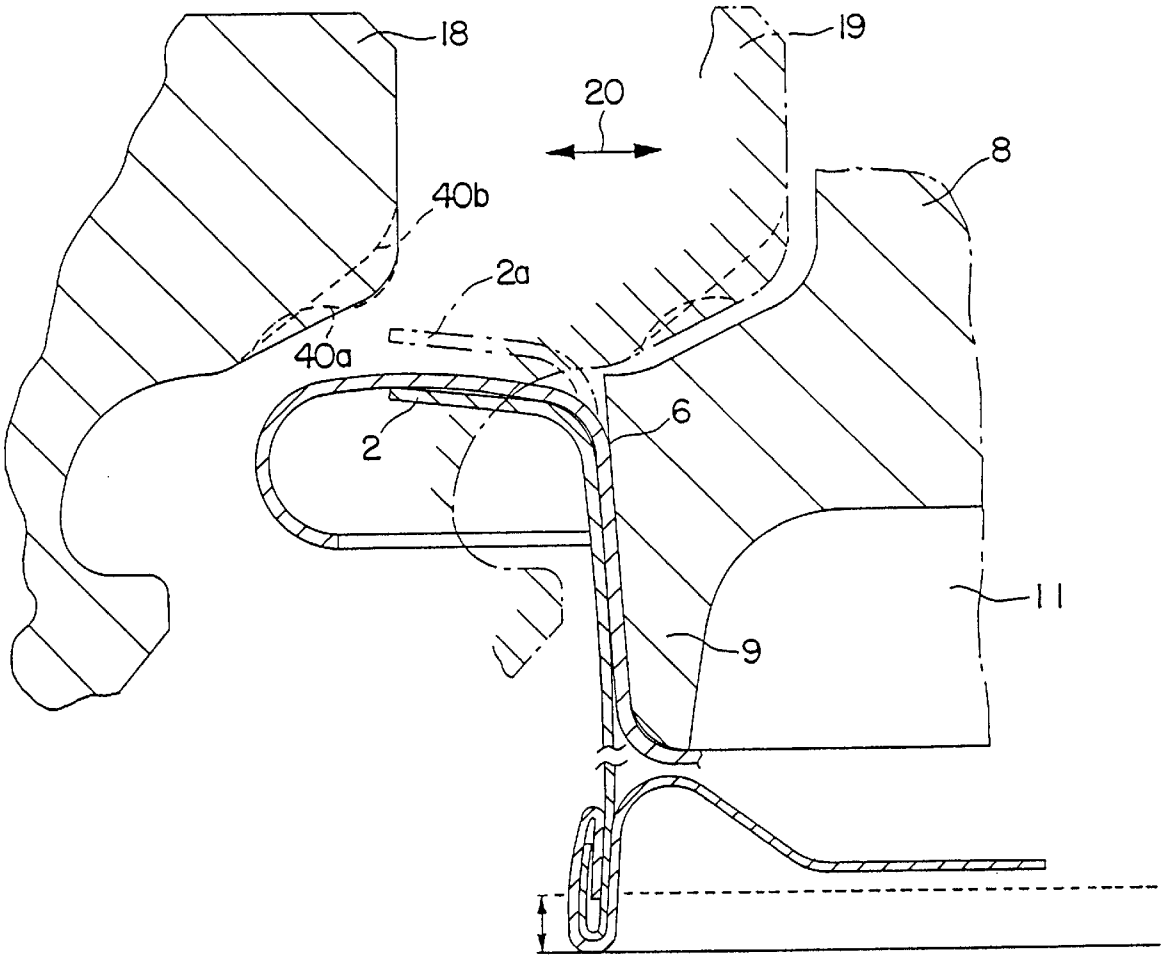
FIGS. 3A and 3B show further details of modified embodiments.
Figure 3B:
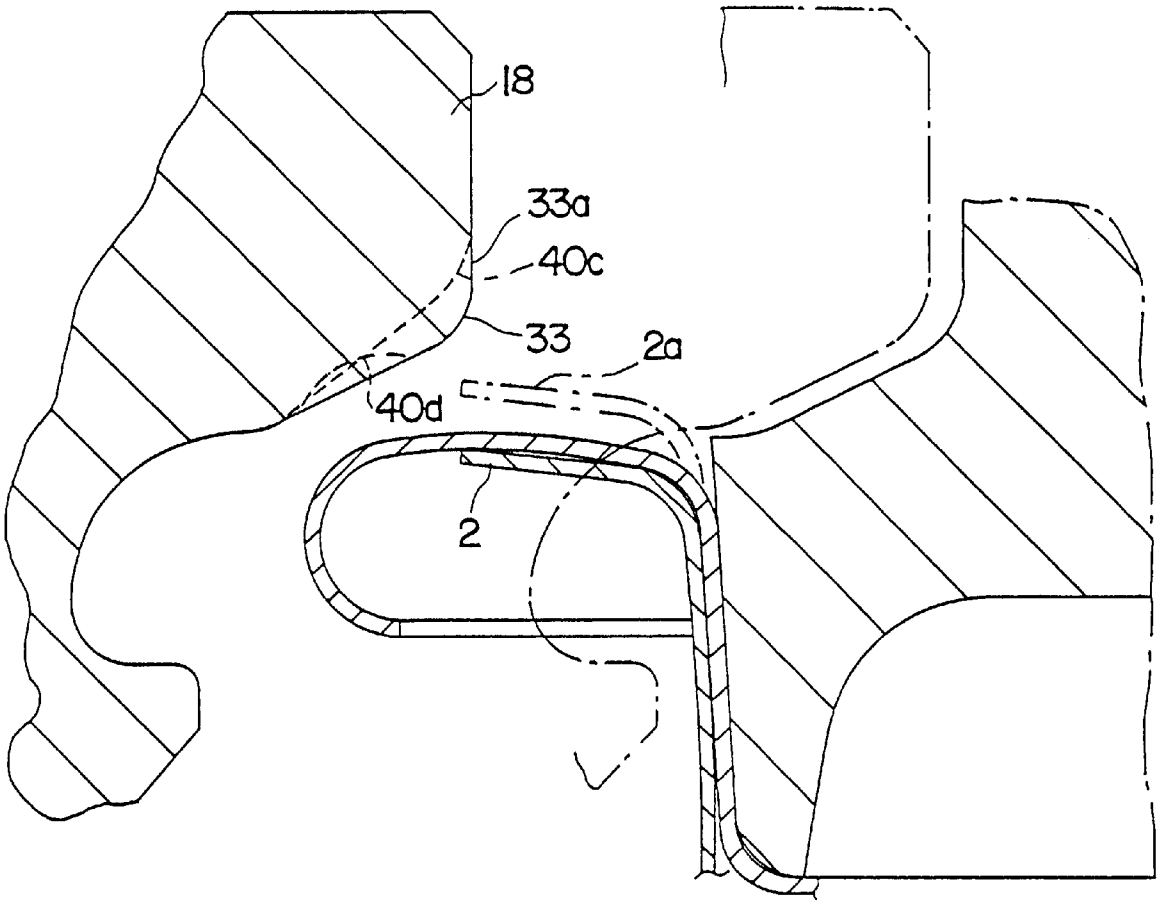

FIG. 3 and FIG. 3A show further possible embodiments of contoured lines according to 40*a* to 40*d*.

What is claimed is:

1. A process for operating a tool for a can seaming machine having a seaming roller for one of a seaming and closing of a can with a can end, said can body standing on a supporting means, having a resiliently supported elevation means, to provide a range of moving between a first and a spaced apart second vertical position;

(i) said first position corresponding to a first position of a flange of said can body, when said can is not depressed by a can end, failed to be placed onto the can flange prior to seaming;

(ii) said second position corresponding to a second position of said flange of said can body, when said can is depressed by a can end placed onto the can flange prior to seaming;

wherein the flange of the can body for seaming with the can end is located at the first vertical position, protrudes in radially outward direction and still receives a deformation component directed in downward direction, although the flange is in its first vertical position located axially higher than it would be located with a corresponding can end placed on said can body flange to depress said flange to said second vertical position, for avoiding breakdown times of said seaming machine when seaming can ends to can body flanges and provide closed cans.

2. A tool for a can seaming machine for one of a seaming and closing of a can body with a tear-off can end, said tool having a tool axis and a supporting means having a resiliently supported elevating means and comprising:

at least one seaming roller being adjustable in radial direction, the seaming roller having a roller axis and a profiled groove adapted for seaming said can end to said can body and having an upper delimitation flank passing over a shoulder into an upper roller section, wherein in cross sectional view said shoulder has, at least in a radially outer area, a contoured line extending from a point near the upper delimitation flank of said profiled groove in radial direction towards said tool axis and in upward direction for defining an annular engaging surface on said seaming roller for providing engagement of said seaming roller in a radially directed movement at an edge of a flared flange of said can body, when said can end is missing, the can body is not depressed and positioned higher than suitable for an engagement of the profiled seaming groove of said roller.

3. Tool according to claim 2, wherein averaged throughout its extension, said contoured line of said seaming roller has an average inclination angle below about 60°, with respect to a plane extending in radial direction with respect to said tool axis.

4. Tool according to claim 2, wherein the supporting means is provided, having said resiliently supported elevating means, providing a resiliently supported range of moving along the tool axis and in cross-sectional view, said contoured line has an extension in direction of said tool axis being at least equal to said range.

5. Tool according to claim 2, wherein for use with seaming machines the cans are rotating during seaming action or inserted axially along the tool axis and standing upright without rotating.

6. A tool for a can seaming machine for one of a seaming and closing of a can body with a tear-off can end, said tool defining a tool axis and comprising:

a supporting means having a resiliently supported elevating means, and further comprising at least one seaming roller being adjustable in radial direction, the seaming roller having a roller axis and a profiled groove adapted for seaming said can end to said can body and having an upper delimitation flank passing over a shoulder into an upper roller section, wherein in cross sectional view said shoulder has, at least in a radially outer area, a contoured line extending from a point near the upper delimitation flank of said profiled groove in radial direction towards said tool axis and in upward direction for defining an annular engaging surface on said seaming roller for providing engagement of said seaming roller in a radially directed movement at an edge of a flared flange of said can body, when said can end is missing the can body is not depressed and positioned higher than suitable for an engagement of the profiled seaming groove of said roller.

* * * * *

UNITED STATES PATENT AND TRADEMARK OFFICE

CERTIFICATE OF CORRECTION

PATENT NO : 6,123,493

DATED : September 26, 2000

INVENTOR(S) : Hans-Dietrich POLITT

It is certified that error appears in the above-identified patent and that said Letters Patent is hereby corrected as shown below:

On the title page

"Assignee:", please correct the name of the Assignee.

Delete "Schmalbach-Lubeca AG" and enter the correct name of the Assignee,

--- Maiko Engineering GmbH ---.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*